US006533574B1

(12) United States Patent
Pechoux

(10) Patent No.: US 6,533,574 B1
(45) Date of Patent: Mar. 18, 2003

(54) SYSTEM FOR ACTIVE REGULATION OF THE AIR/GAS RATIO OF A BURNER INCLUDING A DIFFERENTIAL PRESSURE MEASURING SYSTEM

(75) Inventor: Christophe Pechoux, Torcy (FR)

(73) Assignee: A Theobald SA (FR)

( * ) Notice: Subject to any disclaimer, the term of this patent is extended or adjusted under 35 U.S.C. 154(b) by 0 days.

(21) Appl. No.: 09/623,636

(22) PCT Filed: Mar. 3, 1999

(86) PCT No.: PCT/FR99/00505

§ 371 (c)(1),
(2), (4) Date: Sep. 6, 2000

(87) PCT Pub. No.: WO99/45325

PCT Pub. Date: Sep. 10, 1999

(30) Foreign Application Priority Data

Mar. 6, 1998 (FR) ..... 98-02794

(51) Int. Cl.[7] ..... F23N 5/24
(52) U.S. Cl. ..... 431/90; 431/18; 431/12
(58) Field of Search ..... 431/12, 18, 89, 431/90; 137/100

(56) References Cited

U.S. PATENT DOCUMENTS 4,645,450 A * 2/1987 West
5,520,533 A * 5/1996 Vrolijk

FOREIGN PATENT DOCUMENTS

FR 2437574 * 5/1980
JP 58224226 12/1983
JP 59-212621 * 1/1984
JP 59-212622 * 1/1984
JP 59212621 12/1984
JP 8201206 8/1996

OTHER PUBLICATIONS

Christophe Pechoux et al, "Régulation active du rapport air/gaz d'un brûleur" ["Active regulation of the air/gas ratio of the burner"], Association Technique de l'industrie du Gaz en France [French Gas Industry Technical Association], on the occasion of the 113$^{th}$ Congress du Gaz [Gas Congress] held in Paris on Sep. 10–13, 1996, "Receuil des Communications" ["Proceedings"] vol. 2, pp. 245–251.

* cited by examiner

*Primary Examiner*—Carl D. Price
(74) *Attorney, Agent, or Firm*—Webb Ziesenheim Logsdon Orkin & Hanson, P.C.

(57) ABSTRACT

The system for active regulation of the air/gas ratio of a burner comprises one or two differential pressure measuring systems each of which has a differential pressure sensor with two inlet orifices. The orifices are respectively connected to pressure ports in one of which there is a calibrated throttling orifice. The regulator system comprises a 2-channel valve which, when closed, isolates the two inlet orifices from each other, and, when open, connects them to each other. A measurement circuit is provided and has memory means for storing at least two values of the output signal of the sensors, a control unit for switching the valve and controlling the storage of a first value of an output signal of the sensor in the memory means when the valve is closed and the storage of a second value of the output signal of the sensor when the valve is open, and subtractor means for calculating the difference between the two stored values of the output signal of the sensor and thereby eliminating any drift. In a preferred variant, the regulator system includes only one differential pressure measuring system.

11 Claims, 6 Drawing Sheets

30
47
29
36
Pm
54'
42a
35
33
28
1b
54"
37
3a
9a
54
42b
1a
34
4
2b
3b
39
Pa
27
9b
2a
12b
38
Pg
11a
12a
41
MEASURE
AIR
31
26b
25b
26a
22a
24
MEASURE
REGULATE AIR FLOW
51
22b
32
53
GAS
49
48
MOTOR
55
REGULATE AIR/GAS PRESSURE
43
52
REGULATE TEMPERATURE
CONTROL UNIT
45
23
44
TEMPERATURE SET POINT
46

30
47
29
36
Pm
42a
35
28
33
37
3a
9a
11b
42b
1a
34
4
2b
3b
39
Pa
27
9b
2a
12b
1b
38
Pg
11a
12a
41
MEASURE
AIR
31
26b
26a
22a
25b
24
MEASURE
REGULATE AIR FLOW
51
22b
32
53
GAS
49
48
MOTOR
55
REGULATE AIR/GAS PRESSURE
43
REGULATE TEMPERATURE
CONTROL UNIT
52
45
23
44
TEMPERATURE SET POINT
46

30
47
29
36
Pm
35
57
33
56
37
28
11
34
39
42
Pa
2
3
4
9
38
MOTOR
27
Pg
32
12
1
26
41
SAMPLE AND HOLD
MEASURE
AIR
31
22
59
64
51
24
58
REGULATE AIR FLOW
62
61
GAS
52
66
49
48
63
REGULATE AIR/GAS PRESSURE
SAMPLE AND HOLD
43
25
53
REGULATE TEMPERATURE
CONTROL UNIT
45
23
67
46
44
TEMPERATURE SET POINT

SYSTEM FOR ACTIVE REGULATION OF THE AIR/GAS RATIO OF A BURNER INCLUDING A DIFFERENTIAL PRESSURE MEASURING SYSTEM

The present invention relates to a system for active regulation of the air/gas ratio of a mixture of air and fuel gas fed to a burner, using at least one differential pressure measuring system.

BACKGROUND OF THE INVENTION

In many kinds of apparatus and installations in which one or more liquid or gaseous fluids circulate, it is often necessary to be able to measure accurately the flowrate of a working fluid and/or the pressure difference between two different working fluids in order to monitor and/or regulate and/or adjust a process. A differential pressure system is usually employed for this purpose, comprising a differential pressure sensor with two inlets connected to respective pressure ports. In the case of measuring the flowrate of a fluid, the two pressure ports are on respective opposite sides of a diaphragm placed in the pipe in which the fluid flows. In the case of measuring the pressure difference between two different fluids, the two pressure ports are connected to respective pipes in which the two fluids flow. In both cases, the accuracy of the measured flowrate or pressure difference depends on the accuracy of the differential pressure sensor, especially at low flowrates and low differential pressures. For example, in the case of a flowrate measurement, the pressure difference ΔP and the flowrate Q are related by the following equation:

$$\Delta P = KQ^2 \quad (1)$$

in which K is a coefficient whose value depends in particular on the density of the fluid whose flowrate is to be measured and on the section of the orifice in the diaphragm placed in the pipe in which said fluid flows. If the instantaneous flowrate of a fluid is to be varied over a wide range, for example in a ratio of 1 to 10, the flowrate of the fluid varies in that ratio but the pressure varies in a ratio of 1 to 100.

In other words, a small variation in flowrate corresponds to a much smaller variation in pressure. The differential pressure sensor used to measure the flowrate must therefore be very accurate and very stable so that it can provide a reliable output value for low flowrates. Differential pressure sensors of this kind exist, but they are extremely costly and therefore cannot be used in apparatus where the total cost of manufacture must remain relatively low, for example in a system for regulating the air/gas ratio of a burner, for example the burner of a boiler for producing domestic hot water and/or central heating hot water.

Also, there are differential pressure sensors which are relatively inexpensive but which are subject to thermal drift and long-term drift which often exceed a few percent. The output signal of such sensors can therefore not be used directly for accurate measurement of the pressure difference over a wide range, for example in a ratio of 1 to 100. If an inexpensive sensor is used, it is therefore often necessary to set the zero of the sensor regularly in order to eliminate the drift referred to above. A conventional solution to this problem uses a measuring system like that shown in FIG. 1 of the accompanying drawings (see also "Patent Abstracts of Japan", Volume 009084, date of publication of the abstract Apr. 13, 1985, and Japanese Patent Application JP59212622 in the name of MATSUSHITA DENKI SANGYO, published Dec. 1, 1984).

The differential pressure measuring system shown in FIG. 1 essentially comprises a differential pressure sensor 1 whose inlet orifices 2 and 3 are respectively connected to a pressure port 4 at which in operation there is a pressure P1 and to the common channel 5 of a 3-channel valve 6. The other two channels 7 and 8 of the valve 6 are respectively connected to a pressure port 9 at which in operation there is a pressure P2 (P2≦P1) and to the inlet orifice 2 of the sensor 1 via a pipe 11. In operation the sensor 1 provides at its output 12 a signal which is representative of the pressure difference P1−P2. That signal is fed to the input of switching means 13, one output 14 of which is connected to a first memory 15 and another output 16 of which is connected to a second memory 17. Although two memories 15 and 17 are shown here, the two memories could be separate memory locations of a single memory. The outputs 18 and 19 of the memories 15 and 17 are respectively connected to the positive and negative inputs of algebraic subtractor or adder means 21 which deliver at their output 22 a measurement signal whose value corresponds to the difference between the output signal values from the sensor 1 respectively stored in the memories 15 and 17.

The valve 6 normally connects the inlet orifice 3 of the sensor 1 to the pressure port 9 and the switching means 13 normally connects the output 12 of the sensor 1 to the input of the memory 15. Under these conditions, the memory 15 stores the value of the output signal of the sensor 1, which corresponds to the difference between the pressures P1 and P2. If the pressures P1 and P2 are equal, the value of the output signal of the sensor 1 should normally be zero. However, as indicated above, inexpensive differential pressure sensors are often subject to thermal drift and long-term drift. Because of such drift the value of the output signal of the sensor 1 is not always zero when the pressures P1 and P2 applied to the two inlet orifices 2 and 3 are equal. Consequently, if the two pressures are different, the value of the output signal of the sensor 1 is subject to an error. That error can be corrected in the following manner. At regular intervals, for example every minute, a control unit 23 sends briefly to the valve 6 and to the switching means 13, via respective lines 24 and 25, control signals which momentarily switch the valve 6 to a state such that it disconnects the inlet orifice 3 of the sensor 1 and the pressure port 9 and connects the inlet orifices 2 and 3 of the sensor 1 and momentarily switch the switching means 13 to a state in which they connect the output 12 of the sensor 1 to the input of the memory 17. Under these conditions, the same pressure P1 is applied to the two inlet orifices 2 and 3 of the sensor 1 and any measurement error of the sensor 1 is stored in the memory 17. The subtractor means 21 subtract that error from the value of the output signal of the sensor 1 stored in the memory 15. Thus the measurement error of the sensor 1 is periodically updated in the memory 17 and a corrected measurement signal is obtained at the output 22 of the subtractor means 21 whose value corresponds to the exact value of the difference between the pressures P1 and P2. The components 13, 15, 17 and 22 therefore form a measurement circuit 26 which, in combination with the 3-channel valve 6 and the control unit 23, enables automatic setting of the zero of the sensor 1.

The prior art differential pressure measurement system described with reference to FIG. 1 is entirely satisfactory from the point of view of setting the zero of the sensor. However, it has the drawback of using a 3-channel valve, which is a relatively costly component.

Differential pressure measuring systems of the type described above can be used in systems for regulating the air/gas ratio of a boiler burner. Systems for regulating the air/gas ratio are described in the Japanese Publication already cited, for example, and in the report published by the Association Technique de l'industrie du Gaz en France [French Gas Industry Technical Association], on the occasion of the 113$^{th}$ Congress du Gaz [Gas Congress], held in Paris on Sep. 10–13, 1996, "Receuil des Communications" ["Proceedings"], Volume 2, pages 245–251, in the article "Régulation active du rapport air/gaz d'un brûleur" ["Active regulation of the air/gas ratio of a burner"] by C. PECHOUX et al. The system for regulating the air/gas ratio described in the aforementioned Japanese Publication uses a single differential pressure sensor which measures the difference between the air pressure Pa upstream of the diaphragm in the compressed air supply pipe and the gas pressure Pg downstream of the gas diaphragm in the gas supply pipe. A 3-channel valve and a measuring circuit similar to those described above with reference to FIG. 1 provide automatic setting of the zero of the differential pressure sensor. The system for regulating the air/gas ratio described in the aforementioned report uses two differential pressure sensors, one to measure the difference between the air pressure Pa and the gas pressure Pg, as in the aforementioned Japanese publication, and the other to measure the air flowrate in the compressed air supply pipe. Although in this latter system for regulating the air/gas ratio there is no provision for automatically setting the zero of each of the two differential pressure sensors, this could easily be carried out by associating a two-way valve and a measuring circuit like those described above with reference to FIG. 1 with each of the two sensors. However, a solution of this kind would be relatively costly in that it requires the use of two 3-channel valves and two measuring circuits, one for each sensor.

Patent abstracts of Japan, Volume 008080, date of publication Apr. 12, 1984, and Japanese Patent Application JP58224226, published Dec. 26, 1983, in the name of MATSUSHITA DENKI SANGYO, disclose a system for regulating the air/gas ratio of a burner which uses a single pressure sensor which has a single inlet orifice and is combined with a 3-channel valve so that the sensor alternately measures the air pressure upstream of the air diaphragm and the gas pressure upstream of the gas diaphragm. The pressure sensor is not used as a differential pressure sensor and no means are provided for automatically setting the zero of the sensor.

OBJECTS AND SUMMARY OF THE INVENTION

An object of the present invention is to provide a system for active regulation of the air/gas ratio of a burner using at least one differential pressure measuring system according to the invention.

The differential pressure measuring system employed in the regulation system according to the invention uses a differential pressure sensor which may be subject to thermal drift and long-term drift and includes a measuring circuit for automatically setting the zero of the sensor, said differential pressure measuring system being less costly than the prior art measuring system described above.

The differential pressure measuring system comprises a differential pressure sensor having first and second inlet orifices respectively connected to first and second pressure ports, and an output which, in service, delivers an output signal representative of a pressure difference between the first and second inlet orifices, and a valve which is connected to the first and second inlet orifices of the sensor and which in a first state isolates the two inlet orifices from each other and in a second state connects them to each other, memory means connected to the output of the sensor to memorize at least two values of the sensor output signal. It also comprises a control unit connected to the valve and to the memory means for switching the valve and commanding the storage of a first value of the output signal of the sensor in the memory means when the valve is in its first state and the storage of a second value of the output signal of the sensor in the memory means when the valve is in its second state. It finally comprises measuring means for automatically setting the zero of the sensor.

In a preferred embodiment of the invention, the measuring means consist of memory circuits forming the memory means and subtractor means for calculating the difference between the first and second values of the output signal of the sensor. The measuring circuit delivers at its output a measurement signal representing the exact value of the difference between the respective pressures applied to the first and second inlet orifices of the sensor.

The pressure measuring system further includes a calibrated throttling orifice which is inserted into one of the first and second pressure ports. The valve is a 2-channel valve, a first channel of which is connected to whichever of the first and second pressure ports contains the calibrated throttling orifice, between that calibrated orifice and the corresponding inlet orifice of the sensor. A second channel is connected to the other of the first and second pressure ports. The calibrated orifice has a significantly smaller flow section than that of said 2-channel valve.

With an arrangement of the above kind for setting the zero of the differential pressure sensor, a calibrated throttling orifice and a simple 2-channel valve are used which are easier to manufacture and less costly than the 3-channel valve used in the prior art differential pressure measuring system.

The main object of the invention is therefore a system for active regulation of the air/gas ratio of a burner, comprising an air/gas mixer upstream of the burner, an air pipe containing a calibrated air diaphragm and connected to a first inlet of said air/gas mixer a gas supply pipe containing a calibrated gas diaphragm and connected to a second inlet of said air/gas mixer, both of said pipes being disposed upstream of said calibrated air diaphragm and said calibrated gas diaphragm, means for varying the flowrate of air and means for varying the flowrate of gas sent to said air/gas mixer, and at least one differential pressure measuring system connected to deliver a measurement signal representative of at least one of the following three parameters: the air flowrate in the air pipe, the difference between the air and gas pressures in the air pipe and the gas pipe, and the gas flowrate in the gas pipe, so that the quantity of gas sent to the air/gas mixer is such that the air/gas ratio has a predefined value, wherein each of said differential pressure measuring systems comprises:

a differential pressure sensor having first and second inlet orifices respectively connected to first and second pressure ports, one of which comprises a calibrated throttling orifice, and an outlet which, in service, delivers a signal representative of a pressure difference between the first and second inlet orifices of said sensor, a 2-channel valve, a first channel of which is connected to whichever of the first and second pressure ports contains said calibrated throttling orifice, between that calibrated orifice and the corresponding inlet orifice of the sensor, and whose second channel is connected to the other of the first and second pressure ports, said calibrated orifice having a flow section significantly smaller than that of said 2-channel valve and said 2-channel valve isolating one of the two inlet orifices from the other when it is in a first state and connecting them to each other when it is in a second state, memory means connected to the output of each sensor to store at least two values of the output signal of each sensor, a control unit connected to said 2-channel valve and to the memory means to switch said 2-channel valve and control storage of a first value of the output signal of the sensor in said memory means when the 2-channel valve is in its first state and storage of a second value of the output signal of the sensor in said memory means when the 2-channel valve is in its second state, and means for calculating the difference between said first and second values of the output signal of the sensor, said memory means and said difference calculating means forming a measurement circuit which delivers at its output a measurement signal representative of the exact value of the difference between the respective pressures at the first and second inlet orifices of each sensor.

In a first embodiment of the system for regulating the air/gas ratio, it is possible to use two differential pressure measuring systems according to the invention to measure the flowrate of air in the air pipe and the difference between the air and gas pressures in the air pipe and in the gas pipe, respectively, each of which two systems includes a differential pressure sensor, a calibrated throttling orifice, a 2-channel valve and a measuring circuit. In this case, two 2-channel valves are used which are simpler and less costly than the two 3-channel valves it is necessary to use with the prior art differential pressure measuring systems.

In another embodiment of the system according to the invention for regulating the air/gas ratio, it is possible to use two differential pressure measuring systems according to the invention to measure the air flowrate and the difference between the air and gas pressures, which two systems share a single calibrated throttling orifice and a single 2-channel valve for setting the zero of each of the two differential pressure sensors.

In a preferred embodiment of the system according to the invention for regulating the air/gas ratio, it is possible to use a single differential pressure measuring system according to the invention to measure the air flowrate and the difference between the air and gas pressures or the gas flowrate, subject to the use of an additional 2-channel valve and switching means for directing the output signal from the measuring circuit of the differential pressure measuring system selectively to the unit for regulating the air flowrate and the unit for regulating the gas supply, the latter regulating unit being designed either in the form of an air/gas pressure regulating unit if the differential pressure sensor of the differential pressure measuring system is designed to measure the difference between the air and gas pressures or in the form of a gas flowrate regulation unit if said differential pressure sensor is designed to measure the gas flowrate.

BRIEF DESCRIPTION OF THE DRAWINGS

Other features and advantages of the present invention will become clear after reading the following description of the differential pressure measuring system and various embodiments of the air/gas ratio regulating system, which description is given by way of example only and with reference to the accompanying diagrammatic drawings, in which.

MORE DETAILED DESCRIPTION

Figure 1:
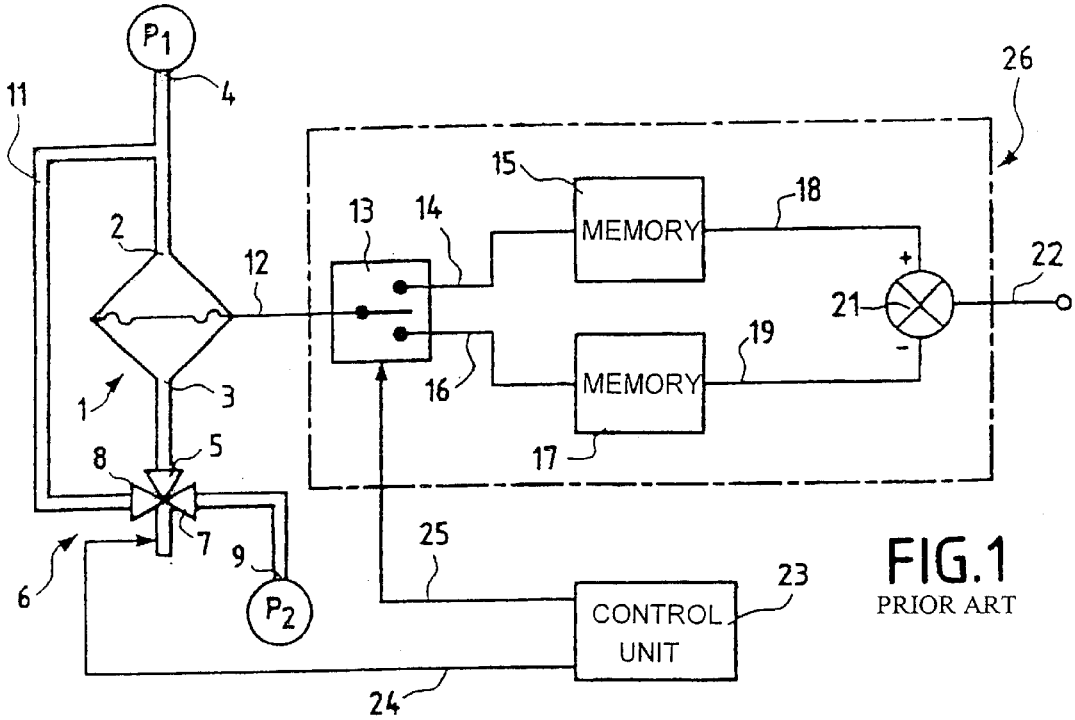
FIG.1 PRIOR ART
FIG. 1 shows a prior art differential pressure measuring system.
Figure 2:
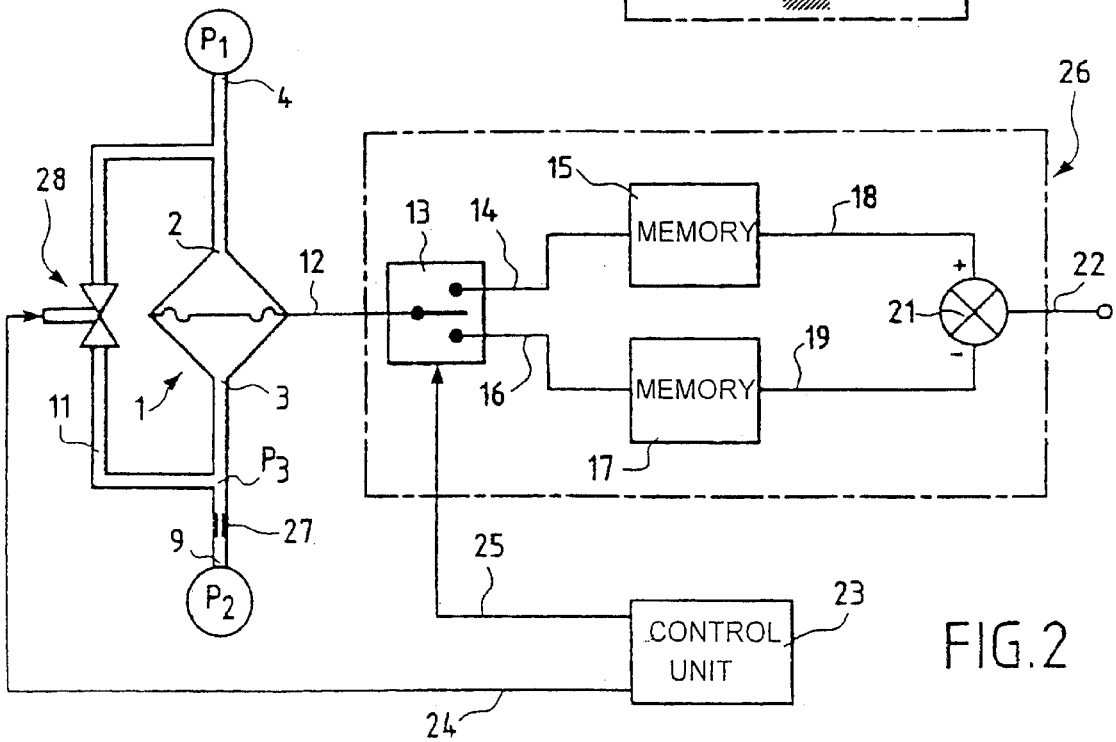
FIG. 2 shows a differential pressure measuring system used in an air/gas ratio regulation system according to the invention.

The differential pressure measuring system according to the invention shown in FIG. 2 is for the most part similar to the prior art measuring system already described with reference to FIG. 1. Consequently, the component parts of the differential pressure measuring system according to the invention, which are identical to those of the prior art system shown in FIG. 1, are designated by the same reference numbers and are not described again in detail. The differential pressure measuring system used in the system according to the invention for regulating the air/gas ratio differs from the prior art system essentially in that it uses a calibrated throttling orifice 27 and a 2-channel valve 28 instead of the 3-channel valve 6. The calibrated orifice 27 is in one of the two pressure ports 4 and 9, for example the pressure port 9, as shown in FIG. 2, and has a flow section significantly smaller than that of the valve 28 when the valve is open. The valve 28 is inserted into the pipe 11 in such a fashion that one of the channels of the valve 28 is connected to the pressure port 4 connected to the inlet orifice 2 of the sensor 1 and the other channel of the valve 28 is connected to the pressure port 9 connected to the inlet orifice 3 of the sensor 1. The pipe 11 is connected between the inlet orifice 3 and the calibrated orifice 27.

In service, the valve 28 is normally closed and the switching means 13 connect the output 12 of the sensor 1 to the input of the memory 15. Under these conditions, if P3 denotes the pressure at the inlet orifice 3 of the sensor 1, the sensor measures the pressure difference P1−P3, where P3=P2, because at this time there is no flow of fluid through the calibrated orifice 27. Consequently, the memory 15 stores the value of the pressure difference P1−P2, which may be subject to a measurement error if the sensor 1 is subject to thermal drift and/or long-term drift.

To calibrate the zero of the sensor 1 at regular intervals, for example every minute, the control unit 23 sends over the line 24 a control signal which opens the valve 28 briefly and, at the same time, the control unit 23 sends over the line 25 a control signal which switches the switching means 13 so that it briefly connects the output of the sensor 1 to the input of the memory 17. Given that, when the valve 28 is open, it has a much larger flow section than the calibrated orifice 27, it is capable of carrying a considerably greater flow than the calibrated orifice 27. Consequently, the head loss P1–P3 of the valve 28 is negligible compared to the head loss P2–P3 of the calibrated orifice 27. Thus when the valve 28 is opened, the pressure P3 is practically equal to the pressure P1. Consequently, during the brief time for which the valve 28 is open, the two inlet orifices 2 and 3 of the sensor 1 are pneumatically or hydraulically short-circuited and the sensor 1 measures a zero pressure difference. At this time, the output signal of the sensor 1, which should be a null signal, is subject to thermal drift or long-term drift, which constitutes a measurement error, and that measurement error is stored in the memory 17 and is subsequently subtracted by the subtractor means 21 from the value of the output signal of the sensor stored in the memory 15. There is therefore obtained at the output 22 of the subtractor means 21 a corrected measurement signal which represents the exact value of the pressure difference P1–P2.

Although they are described in the context of a particular embodiment, it must nevertheless be made clear that the measuring circuits 26 can have various hardware and/or software configurations. In particular, a microprocessor (not shown) could be used, either a microprocessor dedicated to this task or one already included in the regulator system. A microprocessor is generally associated with internal and/or external memory (registers, random access memory, etc.). The subtraction operation can be effected by the arithmetic and logic unit of the microprocessor. All of the operations can be carried out under the control of a dedicated program. Likewise, the control unit 23 can be the same microprocessor. It is only necessary to provide specific input and output interface electronic circuits receiving the output signals from the sensor and transmitting control signals to the valve 28. Those circuits (not shown) handle in particular analogue-to-digital and digital-to-analogue conversion and appropriate level conversion.

Figure 3:
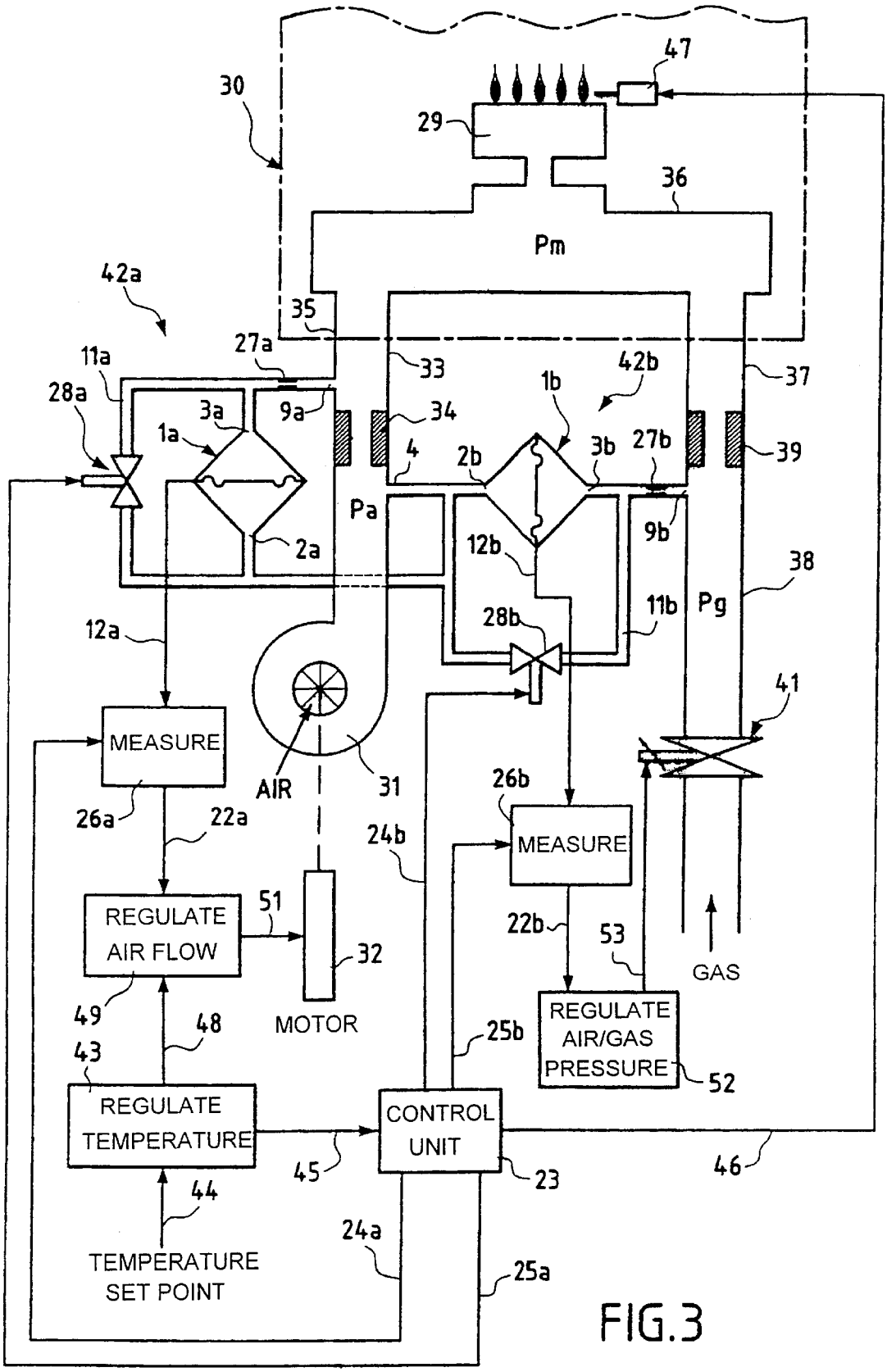
FIG. 3 shows a first embodiment of a system in accordance with the invention for regulating the air/gas ratio of a burner using two differential pressure measuring systems as shown in FIG. 2.

FIG. 3 shows one example of a system constituting a first embodiment of the invention for regulating the air/gas ratio of a burner 29, for example the burner of a boiler 30.

Referring to FIG. 3, a fan 31 is driven by a variable speed electric motor 32 and is connected by a pipe 33 containing a calibrated air diaphragm 34 to a first input 35 of an air/gas mixer 36 upstream of the burner 29. Although the air/gas mixer 36 is shown here as a component separate from the burner 29, it can instead be integrated into the burner, as is well-known in the art. A gas supply pipe 38 connected to a second input 57 of the mixer 36 contains a calibrated gas diaphragm 39 and a proportional valve 41 upstream of that diaphragm whose inlet side is connected to a compressed fuel gas supply (not shown), for example to a compressed fuel gas supply main. The proportional valve 41 is used to vary the gas pressure Pg in the pipe 38 upstream of the calibrated orifice 39 and consequently the quantity of gas fed to the mixer 36.

In FIG. 3, Pa designates the air pressure in the air pipe 33 upstream of the air diaphragm 34 and Pm designates the pressure of the air/gas mixture in the mixer 36. The pressure in the air pipe 33 downstream of the air diaphragm 34 and the pressure in the gas pipe 38 downstream of the gas diaphragm 39 are equal to the pressure Pm when there is a flow of air in the pipe 33 and a flow of gas in the pipe 38.

Two differential pressure measuring systems 42*a* and 42*b* respectively measure the pressure difference Pa–Pm and the pressure difference Pa–Pg. Each of the two differential pressure measuring systems 42*a* and 42*b* is constructed and operates in the same manner as the differential pressure measuring system described with reference to FIG. 2. Their components are therefore designated by the same reference numbers as are used for the differential pressure measuring system shown in FIG. 2, with the suffix "a" for the components of the differential pressure measuring system 42*a* and the suffix "b" for the components of the differential pressure measuring system 42*b*. The two differential pressure measuring systems 42*a* and 42*b* are therefore not described again in detail. Suffice to say that the inlet orifices 2*a* and 2*b* of the sensors 1*a* and 1*b* are connected to a common pressure port 4 connected to the air pipe 33 upstream of the air diaphragm 34. Accordingly, if the inside diameters and the lengths of the respective pipes connecting the two inlet orifices 2*a* and 2*b* to the common pressure port 4 are the same, it is certain that the same pressure value Pa is present at the two inlet orifices 2*a* and 2*b*. However, the inlet orifices 2*a* and 2*b* of the sensors 1*a* and 1*b* can if required be connected to separate pressure ports connected to the air pipe 33 upstream of the air diaphragm 34. The other inlet orifice 3*a* of the sensor 1*a* is connected to the pressure port 9*a* which contains the calibrated throttling orifice 27*a* and is connected to the air pipe 33 downstream of the air diaphragm 34. The other inlet orifice 3*b* of the sensor 1*b* is connected to the pressure port 9*b* which contains the calibrated throttling orifice 27*b* and which is connected to the gas pipe 38 upstream of the gas diaphragm 39.

As shown in FIG. 3, a single control unit 23 can be used to control, via lines 24*a* and 25*a*, the valve 28*a* and the measuring circuit 26*a* of the differential pressure measuring system 42*a* and, via lines 24*b* and 25*b*, the valve 28*b* and the measuring circuit 26*b* of the differential pressure measuring system 42*b*. Under the control of the control unit 23, the zero of the sensors 1*a* and 1*b* of the differential pressure measuring systems 42*a* and 42*b* is set at regular intervals, for example every minute, in exactly the same way as described with reference to FIG. 2. The zeroes of two sensors 1*a* and 1*b* are preferably set simultaneously, but could be set at different times, if required. The measuring circuit 26*a* of the differential pressure measuring system 42*a* therefore delivers at its output 22*a* a corrected measurement signal which represents the exact value of the pressure difference Pa–Pm. Similarly, the measurement circuit 26*b* of the differential pressure measuring system 42*b* delivers at its output 22*b* a corrected measurement signal which represents the exact value of the pressure difference Pa–Pg.

As is well-known in the art, the air flowrate Qa in the air pipe 33 is related to the pressure difference on respective opposite sides of the air diaphragm 34, that is to say the pressure difference Pa–Pm, by the following equation:

$$Pa-Pm=Ka\cdot Q^2a \tag{2}$$

in which Ka is a coefficient whose value depends on the diameter of the calibrated orifice of the air diaphragm 34. Consequently, for an air diaphragm 34 having a given diameter, the measurement signal at the output 22*a* of the measurement circuit 26*a* also indicates the value of the air flowrate Qa in the pipe 33.

The system shown in FIG. 3 for regulating the air/gas ratio further comprises, as known in the art, a temperature regulator unit 43 which receives at its input 44 a temperature set point signal. When the boiler 30 is started up, or if the burner 29 is out and must be lit, the temperature regulator unit 43 sends an ignition request from the burner over a line 45 to the control unit 23 which sends an igniter system 47 a command to ignite the burner 29 over a line 46. The temperature regulator unit 43 delivers at its output 48 an air flowrate set point signal whose value depends on the value of the temperature set point signal applied to the input 44. The air flowrate set point signal delivered by the temperature regulator unit 43 is sent to an input of a conventional air flowrate regulator unit 49 which also receives at another input the corrected measurement signal present at the output 22*a* of the measurement circuit 26*a* and which indicates the value of the air flowrate Qa in the pipe 33. On the basis of the air flowrate set point signal and the measurement signal applied to the inputs of the air flowrate regulator unit 49, the latter produces at its output 51 a control signal which is sent to the motor 32 of the fan 31 in order to vary its rotation speed. The rotation speed of the motor 32 is therefore varied so that the air flowrate Qa produced by the fan 31 in the pipe 33 is equal to the air flowrate set point sent to the air flowrate regulator unit 49 by the temperature regulator unit 43.

On the other hand, the air/gas ratio regulation system shown in FIG. 3 further comprises a conventional air/gas pressure regulator unit 52 receiving at one input the corrected measurement signal which is present at the output 22*b* of the measurement circuit 26*b* and which represents the pressure difference Pa−Pg. On the basis of this corrected measurement signal, the air/gas pressure regulator unit 52 produces at its output 53, in a manner known in the art, a control signal which is sent to the proportional valve 41 in order to vary the gas pressure Pg in the gas pipe 38. The gas pressure Pg is varied by the air/gas pressure regulator unit 52 so that the pressure difference Pa−Pg has a predefined value, for example a null value. In this case, the air/gas pressure regulator unit 52 operates on the proportional valve 41 until the gas pressure Pg is equal to the air pressure Pa, and therefore until the value of the corrected measurement signal present at the output 22*b* of the measurement circuit 26*b* is equal to zero. With this form of pressure regulation, which varies the gas pressure Pg so that it remains at all times equal to the air pressure Pa, which is itself varied by the temperature regulator unit 43 and by the air flowrate regulator unit 49 as a function of the value of the temperature set point applied to the input 44, an air/gas ratio is obtained that is given by the following formula:

$$\text{Air/gas ratio}=Qa/Qg=(d)^{1/2}\cdot(Sa/Sg) \quad (3)$$

in which Qa and Qg are respectively the air flowrate in the air pipe 33 and the gas flowrate in the gas pipe 38, d is the density of the gas, Sa and Sg are respectively the area of the cross-section of the calibrated orifice of the air diaphragm 34 and the area of the cross-section of the calibrated orifice of the gas diaphragm 39. From equation 3, it can be seen that the air/gas ratio is independent of the air pressure Pa and the gas pressure Pg and that its value is constant for a given gas and for air and gas diaphragms whose calibrated orifices have given cross-sections. Accordingly, by choosing the respective diameters of the calibrated orifices of the air diaphragm 34 and the gas diaphragm 39 appropriately, it is possible to obtain an air/gas ratio which has a predefined value chosen as a function of the nature of the gas used and of the type of burner used, in order to obtain good combustion, and the air/gas ratio is maintained constant regardless of the instantaneous value of the air pressure Pa and the gas pressure Pg, which are kept equal to each other, and therefore regardless of the instantaneous power required of the burner.

As is also known in the art, the air/gas pressure regulator unit 52 can be designed so that the gas pressure Pg is slaved to the air pressure Pa, not in such a way that the two pressures remain equal to each other at all times, but instead so that the pressure Pg is related to the pressure Pa by a predetermined relationship which can vary as a function of the instantaneous power required of the burner. For example, a given burner may require an air/gas ratio varying in a predetermined fashion between the minimum power and the maximum power of the burner to obtain good combustion regardless of the instantaneous power required of the burner. To facilitate lighting the burner, when starting it at a given power, it can also be necessary to have a special air/gas ratio during lighting. For example, it can be necessary to increase the richness of the air/gas mixture during the few seconds that it takes to start the burner. To this end, the air/gas pressure regulator unit can be designed to vary the gas pressure Pg to obtain the required air/gas ratio as a function of the instantaneous power required of the burner and/or for a few seconds when lighting the burner, for example.

Figure 4:
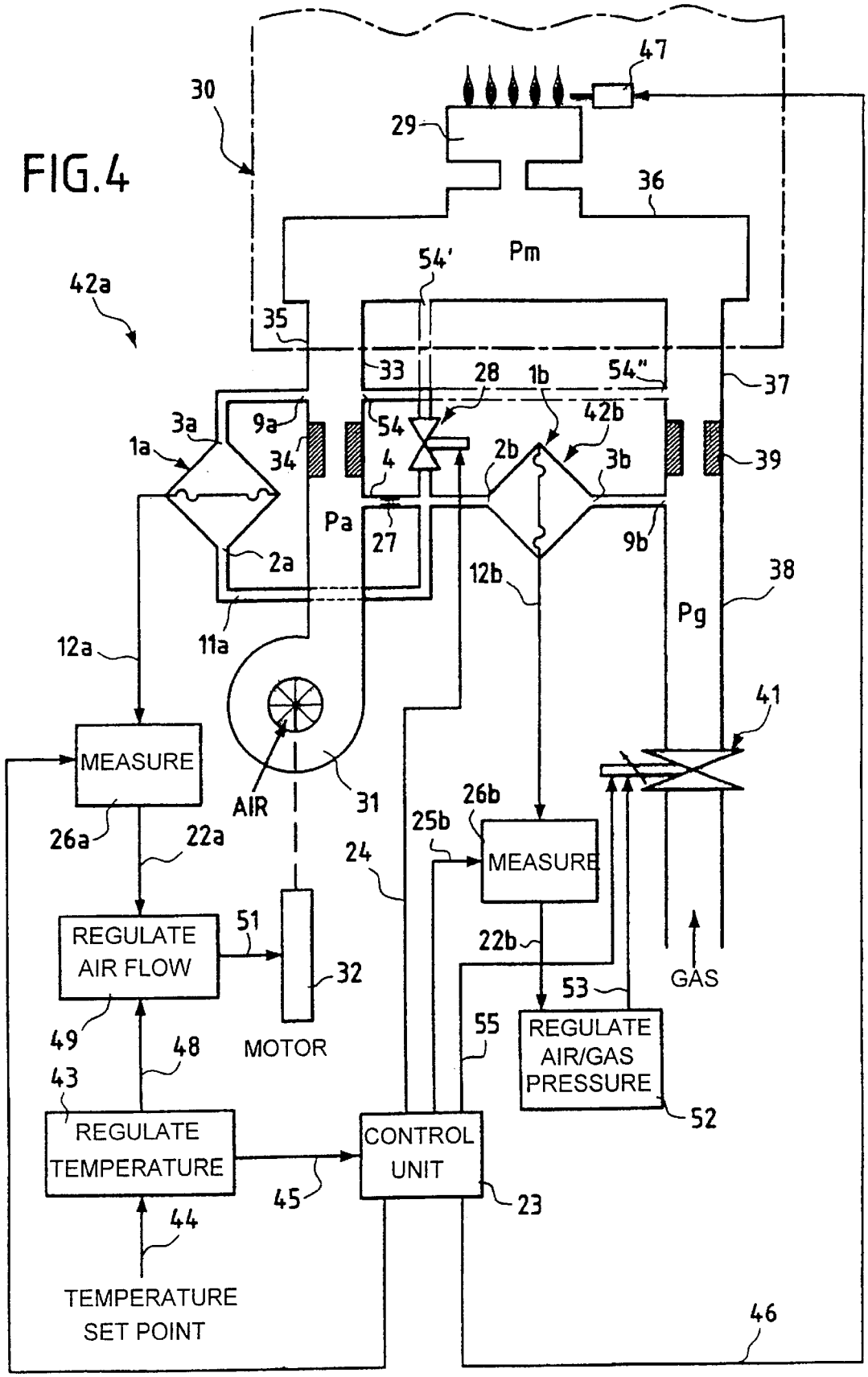
FIG. 4 shows a second embodiment of a system for regulating the air/gas ratio of a burner with two differential pressure measuring systems sharing a calibrated throttling orifice and a 2-channel valve.

FIG. 4 shows a second embodiment of a system for regulating the air/gas ratio of a burner, including a single calibrated throttling orifice and a single 2-channel valve for calibrating two differential pressure sensors. In FIG. 4, components of the air/gas ratio regulator system which are identical to or have the same function as those of the air/gas ratio regulator system shown in FIG. 3 are designated by the same reference numbers and are not described again in detail. The air/gas ratio regulator system shown in FIG. 4 differs from that shown in FIG. 3 essentially in that it has only one calibrated throttling orifice 27, which is located in the common pressure port 4, and only one 2-channel valve 28. One of the two channels of the valve 28 is connected directly to the inlet orifices 2*a* and 2*b* of the sensors 1*a* and 1*b* and via the calibrated throttling orifice 27 to the pressure port 4. The other channel of the valve 28 is connected to a pressure port 54 connected to the air pipe 33 downstream of the air diaphragm 34, where the pressure is equal to the pressure Pm. Instead of being connected to the pressure port 54, the valve 28 could equally well be connected either to the pressure port 9*a* or to the pressure port 54' connected to the mixer 36, or even to the pressure port 54" connected to the gas pipe 38 downstream of the diaphragm 39, given that, in service, the pressure at all these locations is equal to the pressure Pm.

With the arrangement described above, when the valve 28 is opened, the pressure Pm is applied via the pressure port 54 and the valve 28 to the orifices 2*a* and 2*b* of the pressure sensors 1*a* and 1*b*. At this time, the pressure Pm is also applied via the pressure port 9*a* to the inlet orifice 3*a* of the sensor 1*a*. If the proportional valve 41 is at least partly open at this time, the pressure Pg is applied via the pressure port 9*b* to the inlet orifice 3*b* of the sensor 1*b*. On the other hand, if the proportional valve 41 is closed at this time, there is no flow of gas through the gas diaphragm 39 and the pressure Pg is therefore equal to the pressure Pm, and this is the pressure applied via the pressure port 9*b* to the inlet orifice 3*b* of the sensor 1*b*. It can therefore be seen that, to set the zero of the two sensors 1*a* and 1*b*, the control unit 23 must briefly open the valve 28 by placing an appropriate command on the line 24 and, at the same time, it must close the proportional valve 41 by sending it an appropriate command over the line 55. Of course, the control unit 23 must be also send control signals to the measurement circuit 26*a* and 26*b* at this time, via the lines 25*a* and 25*b*, so that they store any measurement error of the sensors 1*a* and 1*b* in their respective memories (which correspond to the memory 17 shown in FIG. 2). On the other hand, if only the zero of the sensor 1*a* is to be set, it is sufficient for the control unit 23 to command brief closing of the valve 28, without closing the valve 41, and at the same time to command the measurement circuit 26*a* to store in its memory the measuring error of the sensor 1*a*. However, in this latter case, the control unit 23 must not send any command over the line 25*b* to the measurement circuit 26*b*, as otherwise the latter would incorrectly store in its memory (17), as a measurement error signal, a signal corresponding to the pressure difference Pm−Pg.

What is more, when the proportional valve 41 is open and the valve 28 is closed, the sensor 1*a* measures the pressure difference Pa−Pm and the sensor 1*b* measures the pressure difference Pa−Pg. Under these conditions, the system shown in FIG. 4 operates in the same manner as that shown in FIG. 3 to regulate the air/gas ratio of the burner 29.

Figure 5:
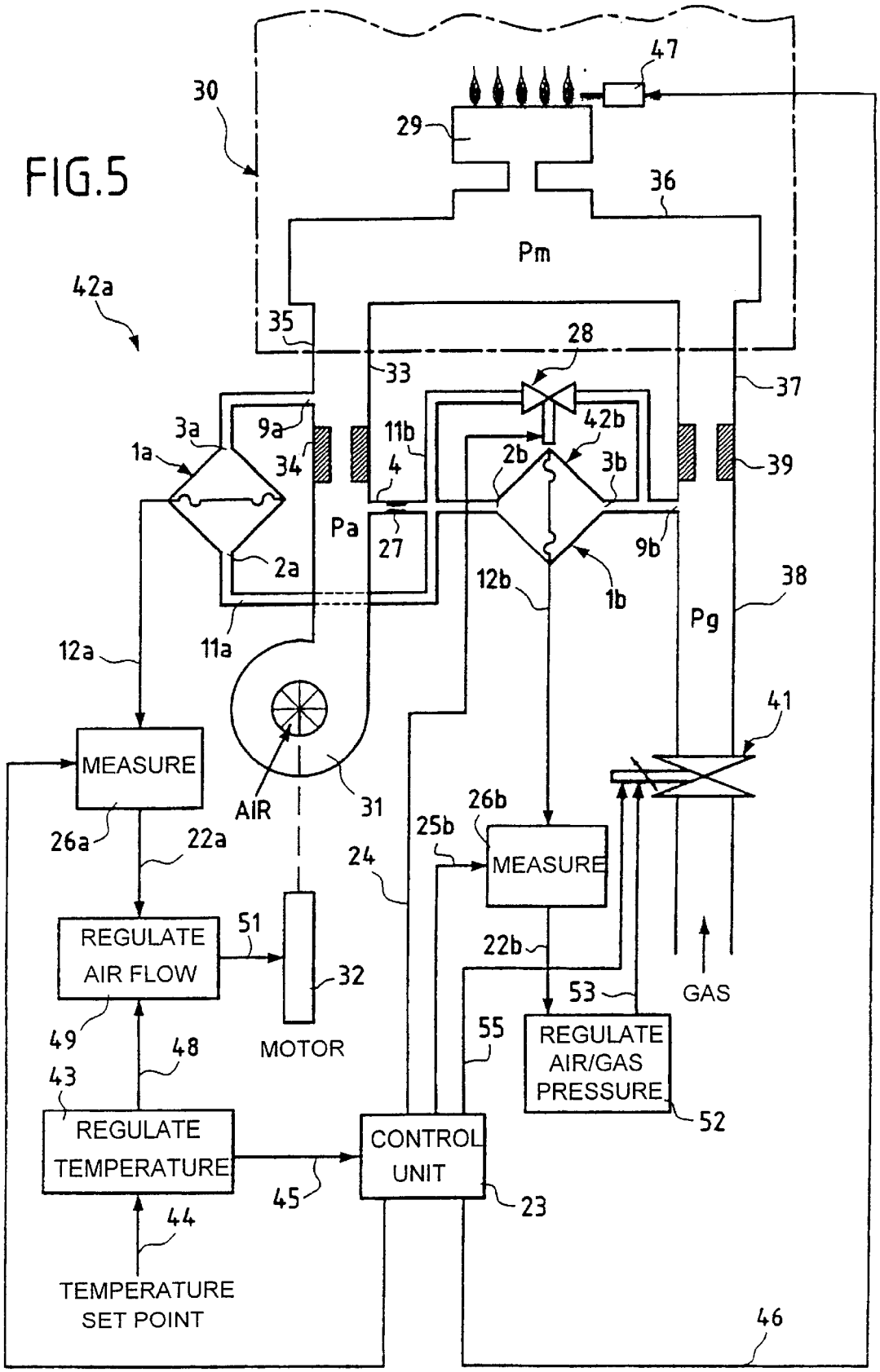
FIG. 5 shows a variant of the regulator system from FIG. 4.

FIG. 5 shows an embodiment of the air/gas ratio regulator system shown in FIG. 4. In FIG. 5, components of the device which are identical to or have the same function as those of the device shown in FIG. 4 are designated by the same reference numbers and are not described again in detail. The system shown in FIG. 5 differs essentially from that shown in FIG. 4 in that one of the two channels of the valve 28 which was connected to the pressure port 54 in the FIG. 4 embodiment is now connected to the inlet orifice 3*b* of the sensor 1*b* and to the pressure port 9*b*. Under these conditions, the gas pressure Pg is applied via the pressure port 9*b* directly to the inlet orifice 3*b* of the sensor 1*b* and, when the valve 28 is open, via the valve and the pipe 11*b* to the inlet orifice 2*b* of the sensor 1*b* and to the inlet orifice 2*a* of the sensor 1*a*. If the proportional valve 41 is closed when the valve 28 is open, there is no flow of gas in the gas pipe 38 and the gas pressure Pg is equal to the pressure Pm. Under these conditions, the pressure Pm is applied to the two inlet orifices 2*a* and 3*a* of the sensor 1*a* and to the two inlet orifices 2*b* and 3*b* of the sensor 1*b*. It is therefore possible to set the zero of the two sensors 1*a* and 1*b* by causing the control unit 23 to send a control signal over the line 24 at regular intervals to open the valve 28 momentarily and a control signal over the line 55 to close the proportional valve 41 at the same time, and so that it also sends control signals over the lines 25*a* and 25*b* so that the measurement circuits 26*a* and 26*b* store the measurement error, if any, produced by the sensors 1*a* and 1*b* in their respective memories (corresponding to the memory 17 shown in FIG. 2). On the other hand, if only the zero of the sensor 1*b* is to set, it is sufficient for the control unit 23 to command opening of the valve 28 via the line 24 and storing of the measurement error of the sensor 1*b* via the line 25*b*. In this case, the control unit 23 must not send any control signal over the line 25*a* to the measurement circuit 26*a*, because the difference between the pressures Pg and Pm respectively applied to the inlet orifices 2*a* and 3*a* of the sensor when the valve 28 is open would be stored as a measurement error in the memory (17) of the measurement circuit 26*a*.

What is more, when the proportional valve 41 is open and the valve 28 is closed, the sensor 1*a* measures the pressure difference Pa−Pm and the sensor 1*b* measures the pressure difference Pa−Pg. Under these conditions, the system shown in FIG. 5 operates in the same manner as those shown in FIGS. 3 and 4 to regulate the air/gas ratio of the burner 29.

Figure 6:
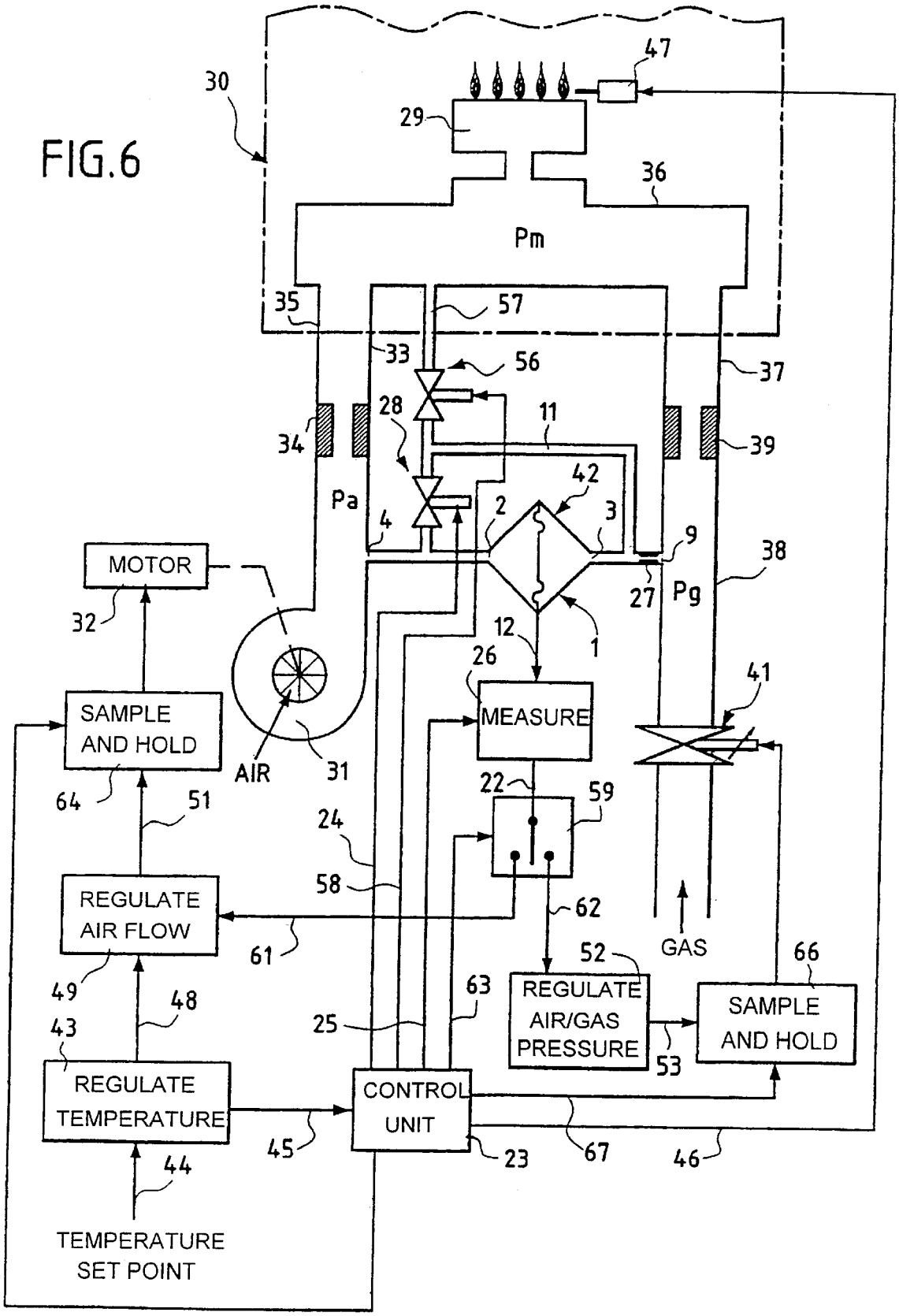
FIG. 6 shows a third and preferred embodiment of a system in accordance with the invention for regulating the air/gas ratio of a burner using a single differential pressure measuring system in accordance with the invention to measure the air flowrate and the difference between the air and gas pressures.

FIG. 6 shows a preferred embodiment of a system for regulating the air/gas ratio of a burner of a boiler. In this embodiment, there is only one differential pressure measuring system 42 for measuring the pressure difference Pa−Pm and the pressure difference Pa−Pg. In FIG. 6, components which are identical to or have the same function as those of the preceding embodiments are designated by the same reference numbers and are not described in detail again. Referring to FIG. 6, the inlet orifice 2 of the sensor 1 is connected to the pressure port 4 connected to the air pipe 33 upstream of the air diaphragm 34. The inlet orifice 3 of the sensor 1 is connected to the pressure port 9 connected to the gas pipe 38 upstream of the gas diaphragm 39 and the calibrated throttling orifice 27 is situated in the pressure port 9 as in the embodiment shown in FIG. 3. One channel of the 2-channel valve 28 is connected to the pressure port 4 and to the inlet orifice 2 of the sensor 1. The other channel of the valve 28 is connected to the inlet orifice 3 of the sensor 1 via the pipe 11 and to one of the two channels of another 2-channel valve 56, the other channel of which is connected to a pressure port 57 at which the pressure is equal to the pressure Pm. In the embodiment shown, the pressure port 57 is connected to the mixer 36, but it could be connected to the air pipe 33 downstream of the air diaphragm 34 or to the gas pipe 38 downstream of the gas diaphragm 39. The control unit 23 controls the valve 56 via a line 58.

The output 22 of the measurement circuit 26 is connected to the input of switch means 59 whose first output is connected by a line 61 to the air flowrate regulator unit 49 and whose second output is connected by a line 62 to the gas pressure regulator unit 52.

The control unit 23 is connected to a control input of the switching means 59 by a line 63. Depending on the status of the control signal on the line 63, the measurement signal present at the output 22 of the measurement circuit 26 is directed by the switching means 59 either to the air flowrate regulator unit 59 via the line 61 or to the air/gas pressure regulator unit 52 via the line 62.

The output 51 of the air flowrate regulator unit 49 is preferably connected to the motor 32 via a sample and hold circuit 64 controlled by the control unit 23 via a line 65. Similarly, the output 53 of the air/gas pressure regulator unit 52 is connected to the proportional valve 41 via a sample and hold circuit 66 which is controlled by the control unit 23 via a line 67.

Figure 7:
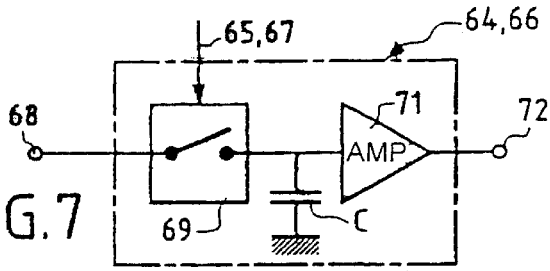
FIG. 7 shows one example of a sample and hold unit that can be used in the regulation system shown in FIG. 6.

If the air flowrate regulator unit 49 and the air/gas pressure regulator unit 52 deliver at their respective outputs 51 and 53 variable voltages for controlling the motor 32 and the proportional valve 41, respectively, each of the two sample and hold circuits 64 and 66 can be of the kind shown in FIG. 7. Each sample and hold circuit 64 or 66 has an input 68 connected by an electronic switch 69 to one side of a capacitor C whose other side is connected to ground and to the input of an amplifier 71 with a high input impedance whose output 72 forms the output of the sample and hold circuit and is connected to the motor 32 or to the proportional valve 41. The electronic switch 69 is controlled by the control unit 23 via the line 65 or 67. When the switch 69 is closed, the control signal, for example a control voltage, delivered to the input 68 by the air flowrate regulator unit 49 or by the air/gas pressure regulator unit 52 is stored in the capacitor C and transmitted by the amplifier 71 to the output 72 and from there to the motor 32 or the proportional valve 41. When the switch 69 is open, the control signal stored in the capacitor C is retained by the capacitor because of the high input impedance of the amplifier 71 and the control signal therefore continues to be present at the output 72 of the sample and hold circuit regardless of the state of its input 68.

Referring again to FIG. 6, it can be seen that when the valve 56 is closed and the valve 28 is briefly opened the pressure Pa is applied via the pressure port 4 to the inlet orifice 2 of the sensor 1 and via the valve 28 and the pipe 11 to the inlet orifice 31 of said sensor. Under these conditions, it is then possible to set the zero of the sensor 1 by storing the measurement error, if any, present at that time at the output 12 of the sensor 1 in the memory (17) of the measurement circuit 26, using an appropriate command sent by the control unit 23 over the line 25. When the valve 28 is closed and the valve 56 is briefly opened, the pressure Pa is applied via the pressure port 4 to the inlet orifice 2 of the sensor 1 and the pressure Pm is applied to the inlet orifice 3 of the sensor 1 via the pressure port 57, the valve 56 and the pipe 11. Under these conditions, the sensor 1 measures the pressure difference Pa−Pm and the measurement circuit 26 provides at its output 22 a corrected measurement signal which represents the value of the air flowrate in the air pipe 33. At this time, the control unit 23 sends an appropriate command over the line 63 to cause the switching means 59 to connect the output 22 of the measurement circuit 26 to the air flowrate regulator unit 49. At the same time as this, the control unit 23 sends a command to close its switch 69 to the sample and hold circuit 64 over the line 65. If the measured air flowrate value does not conform to the set point value delivered at that time by the temperature regulator unit 43 to the air flowrate regulator unit 49, the latter sends a new control signal, for example a control voltage having a new value, from its output 51, and this is stored in the capacitor C of the sample and hold circuit 64 and transmitted to the motor 32 to modify its speed until the air flowrate produced by the fan 31 is equal to the air flowrate set point. When the measured value of the air flowrate has reached the air flowrate set point value, the control unit can command opening of the switch 69 of the sample and hold circuit 64.

When the two valves 28 and 56 are closed, the pressure Pa is applied via the pressure port 4 to the inlet orifice 2 of the sensor 1 and the pressure Pg via the pressure port 9 and the calibrated throttling orifice 27 to the inlet orifice 3 of the sensor 1. Under these conditions, the sensor 1 measures the pressure difference Pa−Pg and the measurement circuit 26 delivers at its output 22 a corrected measurement signal that represents the pressure difference. At this time, the control unit 23 sends an appropriate command over the line 63 to cause the output 22 of the measurement circuit 26 to be connected via the switching means 59 to the air/gas pressure regulator unit 52. At the same time, the control unit 23 commands closing of the switch 69 of the sample and hold circuit 66. If the pressure Pg does not have the required value at this time, for example if it is not equal to the pressure Pa, the air/gas pressure regulator unit 52 produces at its output 53 a new control signal, for example a control voltage having a new value, which is stored in the capacitor C of the sample and hold circuit 66 and transmitted to the proportional valve 41 to vary the pressure Pg towards the required value. When the pressure Pg has reached the required value, the control unit 23 can command opening of the switch 69 of the sample and hold circuit 66.

A typical sequence of commands produced by the control unit 23 of the system shown in FIG. 6 will now be described. When the temperature regulator unit 43 sends a burner ignition request to the control unit 23, the control unit closes the valve 56, opens the valve 28 and sends a control signal to the measurement circuit 26 so that it sets the zero of the pressure sensor 1 by storing in its memory (17) the measurement error, if any, present at the output 12 of the sensor 1.

The control unit 23 then closes the valve 28 and opens the valve 56 so that the sensor 1 can measure the air flowrate in the air pipe 33. At the same time, the control unit 23 causes the switching means 59 to send the measurement signal present at the output of the measurement circuit 26 to the air flowrate regulator unit 49 and closes the switch 69 of the sample and hold circuit 64 so that the regulator unit 49 varies the air flowrate in the pipe 33 in accordance with the set point provided by the temperature regulator unit 43. When the air flowrate has reached the set point value, the control unit 23 cuts off the control signal sent to the motor 32 by opening the switch 69 of the sample and hold circuit 64 and closes the valve 56 (the valve 28 is already closed at this time) so that the sensor 1 can measure the pressure difference Pa−Pg. At the same time, the control unit 23 causes the switching means 59 to send the measurement signal present at the output 22 of the measurement circuit 26 to the air/gas pressure regulator unit 52 and closes the switch 69 of the sample and hold circuit 66 so that the control signal present at the output 53 of the air/gas pressure regulator unit 52 causes the proportional valve 41 to vary the gas pressure Pg, for example so that it becomes equal to the air pressure Pa.

At regular intervals, for example every ten seconds, the control unit 23 opens the switch 69 of the sample and hold circuit 66, closes the valve 28, opens the valve 56, causes the switching means 59 to send the output signal of the measurement circuit 26 to the air flowrate regulator unit 49 and closes the switch 69 of the sample and hold circuit 64, for example for one second. Under these conditions, the regulator unit 49 varies the speed of the motor 32, if necessary, until the air flowrate in the air pipe 33 is equal to the air flowrate set point value produced by the temperature regulator unit 43.

The control unit 23 then places the air/gas ratio regulator system in a state corresponding to air/gas pressure regulation by opening the switch 69 of the sample and hold circuit 64, closing the two valves 28 and 56, causing the switching means 59 to send the output signal of the measurement circuit 26 to the air/gas pressure regulator unit 52 and closing the switch 69 of the sample and hold circuit 66. Under these conditions, the regulator unit 52 operates on the proportional valve 41 to maintain the gas pressure Pg in a predefined relationship to the air pressure Pa, for example Pg=Pa. At regular intervals, for example every minute, the control unit 23 commands setting of the zero of the pressure sensor 1 by opening the switch 69 of each of the two sample and hold circuits 64 and 66, if necessary, closing the valve 56, opening the valve 28 briefly, for example for one second, and causing the measurement circuit 26 to store in its memory (17) the measurement error, if any, present at the output 12 of the sensor 1.

Figure 8:
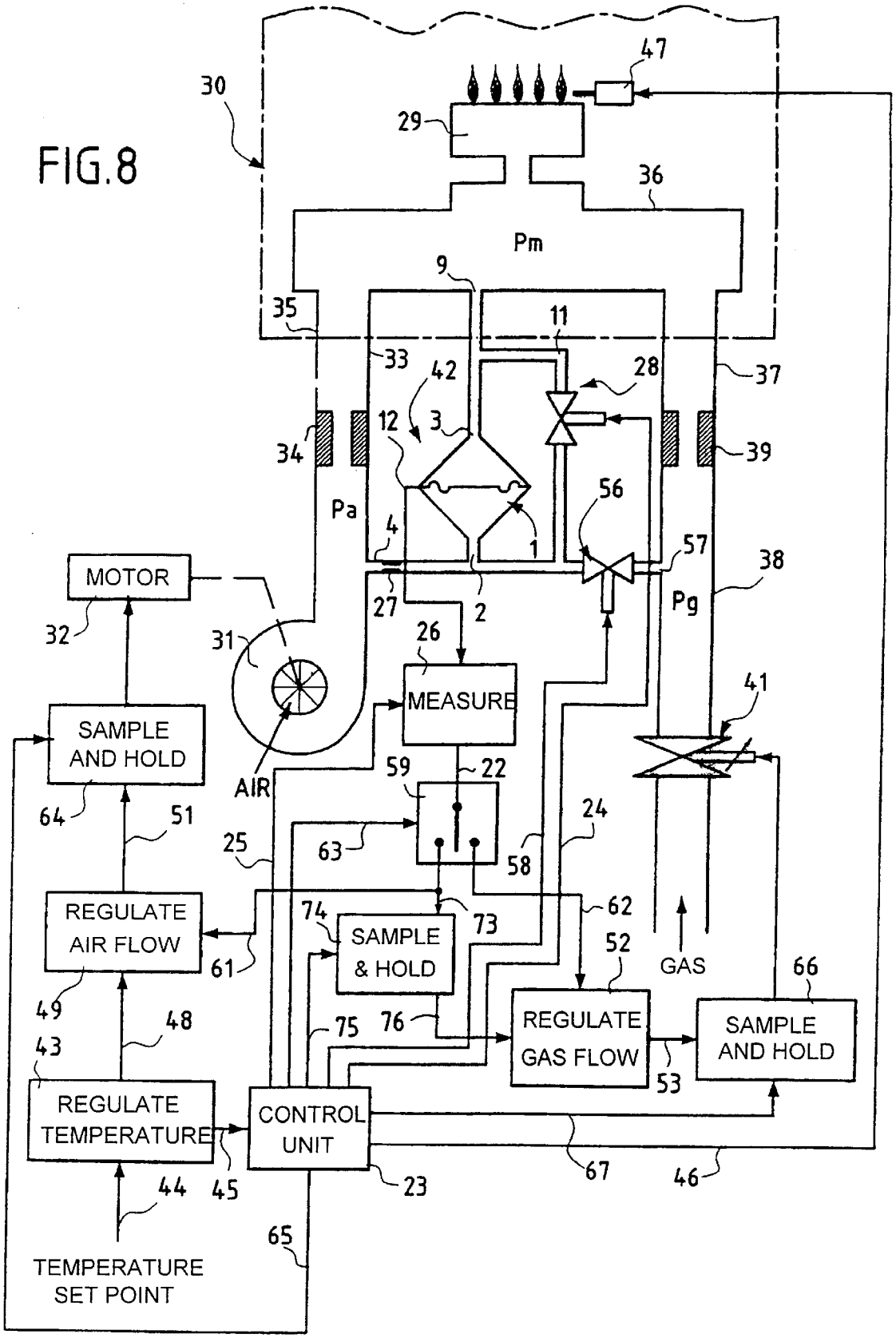
FIG. 8 shows a fourth embodiment of a system in accordance with the invention for regulating the air/gas ratio of a burner, also using a single differential pressure measuring system according to the invention to measure the air flowrate and the gas flowrate.

FIG. 8 shows an embodiment of the system for regulating the air/gas ratio of a burner constituting a variant of the preferred embodiment. This variant also has only one differential pressure measuring system.

In FIG. 8, the components of the system which are identical to or have the same function as those of the system shown in FIG. 6 are designated by the same reference numbers and are not described again in detail. The system shown in FIG. 8 differs from that shown in FIG. 6 in that the inlet orifice 2 of the single differential pressure sensor 1 is connected to the pressure port 4 via the calibrated throttling orifice 27 and to the pressure port 57 on the gas pipe via the valve 56 and the inlet orifice 3 of said sensor 1 is connected directly to the pressure port 9 on the mixer 36, where the pressure is equal to the pressure Pm. Also, the output of the switching means 59 is connected by the line 61 to the air flowrate regulator unit 49 and by a line 73 to another sample and hold circuit 74 which can be the same as the sample and hold circuits 64 and 66 (see FIG. 7) and which is controlled by the control unit 23 via the line 75.

With the arrangement shown in FIG. 8, when the valve 56 is closed and the control unit 23 opens the valve 28 briefly, the two inlet orifices 2 and 3 of the sensor 1 are at the same pressure Pm. Under these conditions, the zero of the sensor 1 can be set in a similar manner to that described above for the previous embodiments.

When the two valves 28 and 56 are closed, the inlet orifices 2 and 3 of the sensor 1 are respectively at the pressure Pa and the pressure Pm and the sensor 1 therefore measures the pressure difference Pa−Pm and consequently gives an indication of the air flowrate in the air pipe 33. Under these conditions, if the switching means 59 at this time send the measurement signal present at the output 22 of the measurement circuit 26 to the air flowrate regulator unit 49, the latter can vary the speed of the motor 32, if necessary, until the flowrate of air in the air pipe 33 is equal to the air flowrate set point supplied by the temperature regulator unit 43 to the air flowrate regulator unit 49, in a manner similar to that described above for the embodiment shown in FIG. 6. However, in the embodiment shown in FIG. 8, the measurement signal which is present at the output 22 of the measurement circuit 26 and which is indicative of the air flowrate is also sent via the switching means 59 and the line 73 to the sample and hold circuit 74, where it is stored and sent over the line 76 to the other input of the regulator unit 52.

When the valve 28 is closed and the valve 56 is briefly opened, the inlet orifices 2 and 3 of the sensor 1 are respectively at the pressure Pg and the pressure Pm. The sensor 1 therefore measures the pressure difference Pg−Pm which, for a particular gas diaphragm 39, gives an indication of the gas flowrate Qg in the gas pipe 38, in accordance with the following equation:

$$Pg-Pm=Kg\cdot Q^2g \tag{4}$$

in which Kg is a coefficient which depends in particular on the density of the gas used and the diameter of the calibrated orifice of the gas diaphragm 39. Under these conditions, the measurement signal present at the output 22 of the measurement circuit 26 gives an indication of the flowrate of the gas in the gas pipe 38. If at this time the control unit 23 causes the switching means 59 to send that measurement signal via the line 62 to the regulator unit 52, the latter receives at its inputs, via the respective lines 76 and 62, a signal whose value is indicative of the air flowrate in the pipe 33 and a signal whose value is indicative of the gas flowrate in the pipe 38. In this case, the regulator unit 52 is designed as a gas flowrate regulator unit, i.e. it causes the proportional value 41 to vary the gas flowrate Qg so that the ratio Qa/Qg, i.e. the air/gas ratio, has a predefined value.

When the temperature regulator unit 43 sends a burner ignition request to the control unit 23, the sequence of operations commanded by the unit 23 can be as follows:

First of all, the control unit 23 sets the zero of the sensor 1 by closing the valve 56, if it was open, briefly opening the valve 28, and sending a control signal to the measurement circuit 26 via the line 25 so that it stores in its memory (17) the measurement error, if any, present at this time at the output 12 of the sensor 1.

The control unit 23 then closes the valve 28, operates on the switching means so that they connect the output 22 of the measuring circuit 26 to the air flowrate regulator unit 49 and to the sample and hold circuit 74, closes the switch 69 of the sample and hold circuit 74 and closes the switch 69 of the sample and hold circuit 64 so that the regulator unit 49 varies the air flowrate in the air pipe 33 until it is equal to the air flowrate set point value delivered by the temperature regulator unit 43.

When the air flowrate in the pipe 33 has reached the set point value, the control unit 23 opens the switch 69 of the sample and hold circuit 64, opens the switch of the sample and hold circuit 74 to retain therein the differential pressure value Pa−Pm representing the air flowrate, opens the valve 56 (the valve 28 is already closed at this time), causes the switching means 59 to connect the output 22 of the measurement circuit 26 to the gas flowrate regulator unit 52 via the line 62 and closes the switch 69 of the sample and hold circuit 66 so that the regulator unit 52 adjusts the proportional valve 41 to obtain a gas pressure Pg such that the pressure difference Pg−Pm measured by the sensor 1 is equal to the differential pressure value stored in the sample and hold circuit 74. This system works because the sections Sa and Sg of the calibrated orifices of the air diaphragm 34 and the gas diaphragm 39 are chosen to obtain the required air/gas ratio, in accordance with equation (3) above.

Then, at regular intervals, for example every ten seconds, the control unit 23 opens the switch 69 of the sample and hold circuit 66, closes the valves 28 and 56, if they are open, causes the switching means 59 to direct the output signal from the measurement circuit 26 to the air flowrate regulator unit 49, closes the switch 69 of the sample and hold circuit 64 in order to vary the air flowrate in the air pipe 33, if necessary, closes the switch 69 of the sample and hold circuit 74 to update the differential pressure value representing the air flowrate stored in the sample and hold circuit 74, if necessary, opens the switch 69 of the sample and hold circuit 64, opens the valve 56, causes the switching circuit 59 to direct the output signal of the measurement circuit 26 to the regulator unit 52 via the line 62, closes the switch 69 of the sample and hold circuit 66 to vary the gas flowrate in the gas pipe 38 as required and then opens the switch 69 of the sample and hold circuit 66 and closes the valve 56.

At regular intervals, for example every minute, the control unit sets the zero of the sensor 1 by performing the operations already described.

It goes without saying that the embodiments of the invention described above have been given by way of illustrative and non-limiting example only and that many modifications can readily be made to them by the skilled person without departing from the scope of the invention. For example, some of the functions performed by the various circuits described above, for example the measurement circuit or circuits 26, the control unit 23, the switching means 59, the regulator units 43, 49 and 52, and the sample and hold circuits 64, 66 and 74, can be performed either by discrete electronic circuits like those described above or by an appropriately programmed microprocessor.

Similarly, in FIGS. 3, 4, 5, 6 and 8, the fan 31 is shown upstream of the air flowrate measuring orifice 34, but it could very well be situated between the mixer 36 and the burner 29 or even beyond the burner, downstream of the temperature exchanger of the boiler, for example.

In the situation in which the fan is upstream of the orifice 34, as shown in FIGS. 3 to 8, the air flowrate is "pushed" by the fan. However, if the fan is between the mixer and the burner, or beyond the burner, the ventilator aspirates the mixture.

A reading of the foregoing description shows clearly that the invention achieves the stated objects.

It must nevertheless be made clear that the invention is not limited to the embodiments explicitly described, in particular the embodiments explicitly described with reference to FIGS. 2 to 8.

In particular, as already indicated, the measurement circuits can have various configurations.

It must also be made clear that, although particularly suitable for regulating a boiler burner for producing domestic hot water and/or central heating hot water, the invention is not restricted to this type of application. It applies more generally whenever it is necessary to regulate actively the air/gas ratio of air and fuel gas fed to a burner using at least one differential pressure measuring system.

What is claimed is:

1. A system for active regulation of air/gas ratio of a burner, comprising an air/gas mixer upstream of the burner, an air pipe housing a calibrated air diaphragm and connected to a first inlet of said air/gas mixer, a gas supply pipe housing a calibrated gas diaphragm and connected to a second inlet of said air/gas mixer means for varying a flowrate of air and means for varying a flowrate of gas sent to said air/gas mixer, and at least one differential pressure measuring system connected to deliver a measurement signal representative of at least one of the following three parameters: the air flowrate in the air pipe, the difference between air and gas pressures in the air pipe and the gas pipe, and the gas flowrate in the gas pipe, so that the quantity of gas sent to the air/gas mixer is such that the air/gas ratio has a predefined value, wherein each of said differential pressure measuring systems comprises:

a differential pressure sensor having first and second inlet orifices respectively connected to first and second pressure ports, one of said pressure ports comprises a calibrated throttling orifice, and an output configured to deliver a signal representative of a pressure difference between the first and second inlet orifices of said sensor, a 2-channel valve, a first channel of which is connected to whichever of the first and second pressure ports contains said calibrated throttling orifice, between that calibrated orifice and the corresponding inlet orifice of the sensor, and whose second channel is connected to the other of the first and second pressure ports, said calibrated orifice having a flow section significantly smaller than that of said 2-channel valve and said 2-channel valve isolating one of the two inlet orifices from the other when it is in a first state and connecting them to each other when it is in a second state, memory means connected to the output of each sensor to store at least two values of the output signal of each sensor, a control unit connected to said 2-channel valve and to the memory means to switch said 2-channel valve and control storage of a first value of the output signal of the sensor in said memory means when the 2-channel valve is in its first state and storage of a second value of the output signal of the sensor in said memory means when the 2-channel valve is in its second state, and means for calculating a difference between said first and second values of the output signal of the sensor, said memory means and said difference calculating means forming a measurement circuit which delivers at its output a measurement signal representative of the value of a difference between respective pressures at the first and second inlet orifices of each sensor.

2. The system according to claim 1 for the active regulation of air/gas ratio, wherein said means for varying the flowrate of air and gas sent to said air/gas mixer comprise a fan driven by a variable speed electric motor, a temperature regulator unit delivering at its output an air flowrate set point signal whose value depends on a required temperature value, an air flowrate regulator unit which receives at a first input a first measurement signal representative of the air flowrate in the air pipe and at a second input said air flowrate set point signal, and which produces at its output a control signal for said electric motor of the fan such that an air flowrate produced by the fan is equal to said air flowrate set point, a gas supply regulator unit which receives at its input at least a second measurement signal representative of one of the following two parameters: a difference between air and gas pressures in the air and gas pipes, respectively, and the gas flowrate in the gas pipe, and which produces at its output a control signal for a proportional valve varying a quantity of gas sent to the air/gas mixer so as to make said air/gas ratio equal to the predefined value.

3. The system according to claim 1 for the active regulation of air/gas ratio, wherein said measurement circuit comprises a switch with two output channels receiving at its input said output signal of a differential pressure sensor, two memory circuits each connected to one of the output channels of said switch, and a two-input subtractor circuit, each input of which receives output signals from one of said memory circuits and which delivers at its output said measurement signal representing the value of the difference between the respective pressures at the first and second inlet orifices of said sensor, switching from one of the output channels to the other channel being controlled by said control unit.

4. The system according to claim 1 for the active regulation of an air/gas ratio, the system comprising a first differential pressure measuring system including a differential pressure sensor whose two inlet orifices are respectively connected to first and second pressure ports on the air pipe and respectively upstream of and downstream of the air diaphragm and a first measurement circuit which is connected to the output of the first sensor and which delivers at its output said first measurement signal which is representative of the air flowrate in the air pipe, and a second differential pressure measuring system including a differential pressure sensor whose two inlet orifices are respectively connected to a third pressure port on the air pipe upstream of the air diaphragm and a fourth pressure port on the gas pipe upstream of the gas diaphragm and a second measurement circuit which is connected to the output of the second sensor and which delivers at its output said second measurement signal which is representative of the difference between the air and gas pressures.

5. The system according to claim 4 for the active regulation of the air/gas ratio of a burner, wherein the first and third pressure ports consist of one and same pressure port which forms a pressure port common to the first and second differential pressure measuring systems.

6. The system according to claim 5 for the active regulation of the air/gas ratio of a burner, wherein each of the first and second differential pressure measuring systems includes its own 2-channel valve and its own calibrated throttling orifice, the calibrated throttling orifice of the first differential pressure measuring system being in said second pressure port and the calibrated throttling orifice of the second differential pressure measuring system being-in the fourth pressure port.

7. The system according to claim 5 for the active regulation of the air/gas ratio of a burner, wherein the first and second differential pressure measuring systems have a common-calibrated throttling orifice which is in said common pressure port and a common 2-channel valve, one of whose two channels is connected to the common pressure port between the throttling orifice and the inlet orifices of the first and second sensors which are connected to the common pressure port and the other of whose two channels is connected to the second pressure port or to a pressure port at which the pressure is equal to that at the second pressure port.

8. The system according to claim 5 for the active regulation of the air/gas ratio of a burner, wherein the first and second differential pressure measuring systems have a common calibrated throttling orifice which is in said common pressure port and a common 2-channel valve one of whose two channels is connected to the common pressure port between the common throttling orifice and the inlet orifices of the first and second sensors which are connected to the common pressure port and the other of whose two channels is connected to the fourth pressure port.

9. The system according to claim 3 for the active regulation of the air/gas ratio of a burner, the system comprising a single differential pressure measuring system whose first pressure port is on the air pipe upstream of the air diaphragm and whose second pressure port is on a gas pipe upstream of the gas diaphragm, and the system further comprising another 2-channel valve which is controlled by the control unit of the differential pressure measuring system and one of whose two channels is connected to whichever of the first and second pressure ports contains said calibrated throttling orifice, between that calibrated orifice and the corresponding inlet orifice of the sensor, and the other of whose two channels is connected to a third pressure port in which the pressure is equal to the pressure in the air/gas mixer, and switching means having an input connected to the output of the measurement circuit of the differential pressure measuring system and two outputs respectively connected to the first input of said air flowrate regulator unit and to the input of said gas supply regulator unit, said switching means being controlled by said control unit to connect the output of said measuring circuit selectively to the first input of said air flowrate regulator unit when said control unit closes the 2-channel valve of the differential pressure measuring system and opens said other 2-channel valve and to the inlet of said gas supply regulator unit when said control unit closes the two 2-channel valves.

10. The system according to claim 3 for the active regulation of the air/gas ratio of a burner, the system comprising a single differential pressure measuring system whose first pressure port is on the air pipe upstream of the air diaphragm and contains said calibrated throttling orifice and whose second pressure port is connected to a point at which a pressure is equal to the pressure in the air/gas mixer and the system further comprising another 2-channel valve which is controlled by the control unit of the differential pressure measuring system and one of whose two channels is connected to the first inlet orifice of the differential pressure sensor of the differential pressure measuring system and the other of whose two channels is connected to a third pressure port on the gas pipe upstream of the gas diaphragm, and switching means having an input connected to the output of the measurement circuit of the differential pressure measuring system and two outputs one of which is connected to the first input of said air flowrate regulator unit and via a sample and hold circuit to a first input of said gas supply regulator unit and the other output of which is connected to a second input of said gas supply regulator unit, said switching means and said sample and hold circuit being controlled by said control unit so that the output of said measurement circuit is connected to the first input of said air flowrate regulator unit and to said sample and hold circuit when said control unit closes the 2-channel valve of the differential pressure measuring system and closes said other 2-channel valve and so that the output of said measurement circuit is connected to the second input of said gas supply regulator unit when said control unit closes the 2-channel valve of the differential pressure measuring system and opens said other 2-channel valve.

11. The system according to claim 9 for the active regulation of the air/gas ratio of a burner, wherein the output of said air flowrate regulator unit is connected to the motor of the fan via a sample and hold circuit which is controlled by said control unit so that the control signal produced by said air flowrate regulator unit is updated and stored in said sample and hold circuit each time that the output of said measurement circuit is connected by the switching means to the first input of the air flowrate regulator unit, and wherein said gas supply regulator unit is connected to the proportional valve via another sample and hold circuit which is controlled by the control unit so that the control signal produced by said gas supply regulator unit is updated and stored in said other sample and hold circuit each time that the output of said measurement circuit is connected by the switching means to the second input of the gas supply regulator unit.

* * * * *

UNITED STATES PATENT AND TRADEMARK OFFICE

CERTIFICATE OF CORRECTION

PATENT NO. : 6,533,574 B1
DATED : March 18, 2003
INVENTOR(S) : Pechoux

It is certified that error appears in the above-identified patent and that said Letters Patent is hereby corrected as shown below:

Title page,
Item [22], PCT filing date "Mar. 3, 1999" should read -- Mar. 5, 1999 --.

Column 7,
Line 53, "second input 57" should read -- second input 37 --.

Column 18,
Line 58, between "being" and "in" delete hyphen.

Signed and Sealed this

Sixteenth Day of September, 2003

JAMES E. ROGAN
*Director of the United States Patent and Trademark Office*